US005772544A

United States Patent [19]

Yang

[11] Patent Number: 5,772,544

[45] Date of Patent: Jun. 30, 1998

[54] BASEBALL AND SOFTBALL

[76] Inventor: Wen Hsiang Yang, No. 201, Chong Don Street, Kaoshiung, Taiwan

[21] Appl. No.: 837,572

[22] Filed: Apr. 21, 1997

[51] Int. Cl.[6] ..... A63B 37/12

[52] U.S. Cl. ..... 473/598

[58] Field of Search ..... 473/597, 598, 473/600, 601, 602, 607, 608

[56] References Cited

U.S. PATENT DOCUMENTS 1,861,157 5/1932 Grady ..... 473/598
1,980,472 11/1934 Clarke ..... 473/598
2,815,211 12/1957 Grandinette ..... 473/598
5,253,865 10/1993 Kinnee ..... 473/598

*Primary Examiner*—Steven B. Wong

[57] ABSTRACT

A baseball or a softball includes two or more cover members engaged on the outer portion of a core and having an abutting peripheral portion. A pad is engaged between the core and the abutting peripheral portion of the two cover members and is stitched and secured to the abutting peripheral portion of the cover members by a thread. When the thread is tightened, a number of bulges may be formed along the abutting peripheral portion of the cover members. The thread may be engaged between and protected by the bulges from being easily worn out.

1 Claim, 2 Drawing Sheets

BASEBALL AND SOFTBALL

BACKGROUND OF THE INVENTION

1. Field of the Invention

The present invention relates to a ball, and more particularly to a baseball and a softball.

2. Description of the Prior Art

Typical baseballs and softballs comprise a core and an outer cover engaged on the core. The outer cover normally includes two 8-shaped members hand stitched together by thread. However, after stitching operation, the thread will expose and will be easily worn out after usage, such that the thread will be easily broken. The thread thus should be selected from that having greater size. However, no matter how large size is, the thread will also be easily broken due to abrasion and scratch and friction.

The present invention has arisen to mitigate and/or obviate the afore-described disadvantages of the conventional baseballs and softballs.

SUMMARY OF THE INVENTION

The primary objective of the present invention is to provide a baseball or a softball in which the thread for securing the two cover members together may be suitably protected from being easily worn out.

In accordance with one aspect of the invention, there is provided a ball comprising a core, at least two cover members engaged on the core and including an abutting peripheral portion, a pad engaged between the abutting peripheral portion of the at least two cover members and the core, and at least one thread stitched along the abutting peripheral portion of the two cover members for securing the pad and the abutting peripheral portion of the two cover members together and for allowing bulges to be formed on the abutting peripheral portion and for allowing the thread to be engaged between and protected by the bulges.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
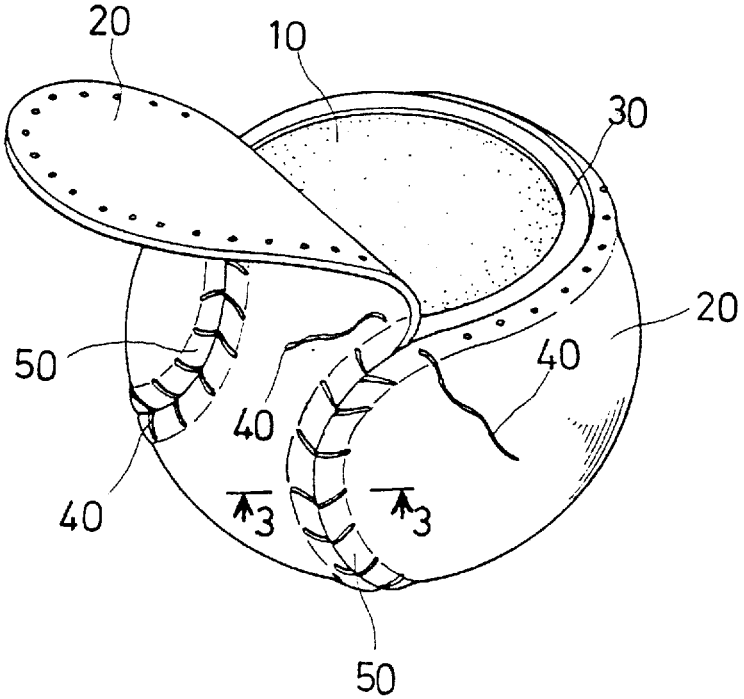
FIG. 1 is a perspective view of a ball in accordance with the present invention, in which a portion of the outer cover is opened.
Figure 2:
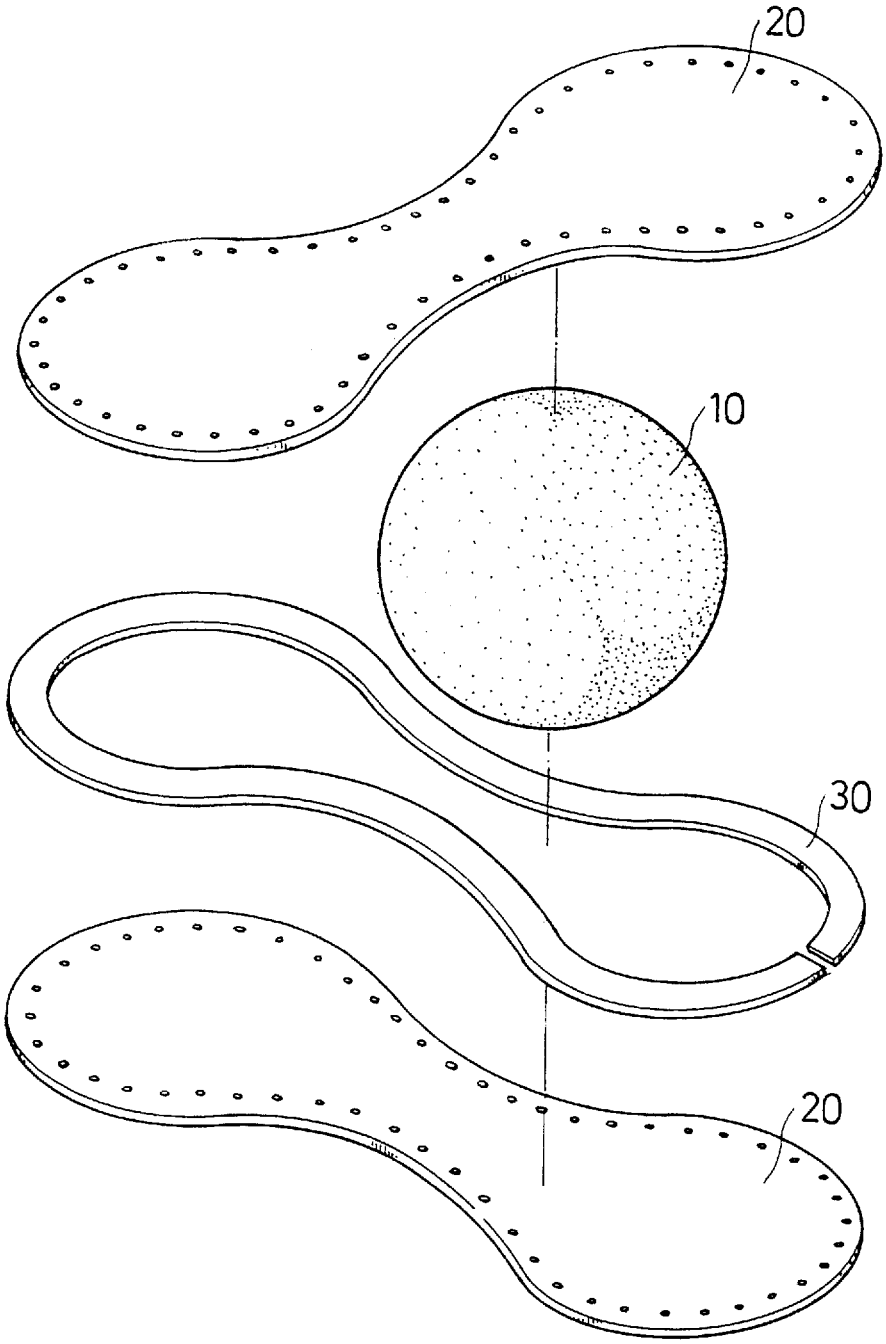
FIG. 2 is an exploded view of the ball.

Referring to the drawings, and initially to FIGS. 1 and 2, a ball in accordance with the present invention may either be a baseball or a softball. The ball comprises a core 10 and an outer cover 20 engaged on the outer portion of the core 10. The outer cover 20 includes two 8-shaped cover members 20 stitched together along the abutting peripheral portion by one or more threads 40. A substantially 8-shaped pad 30 is engaged between the abutting peripheral portion of the two cover members 20 and the core 10 and is secured to the abutting peripheral portion of the two cover members 20 by the thread 40. The outer cover may include two or more cover members stitched together.

Figure 3:
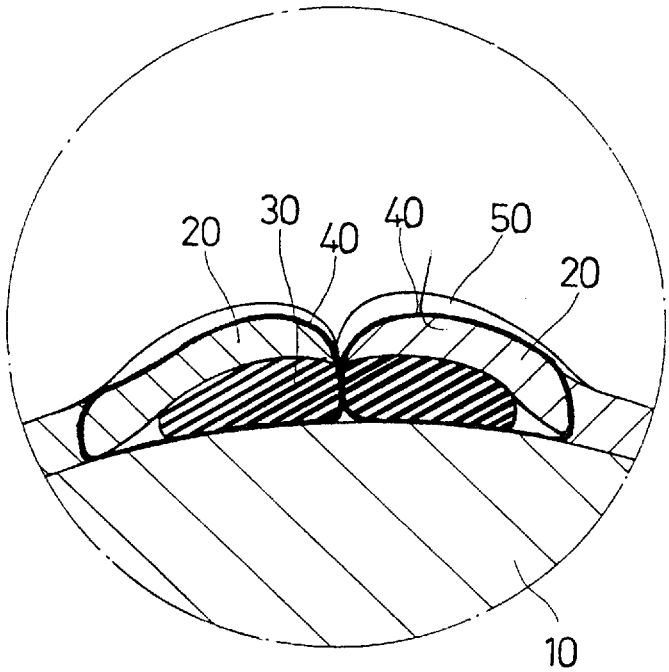
FIG. 3 is a cross sectional view taken along lines 3—3 of FIG. 1.

Referring next to FIG. 3 and again to FIG. 1, the pad 30 is made of soft or resilient material, such as rubber, leather, plastic material etc., such that the thread 40 may be engaged into the cover members 20 and engaged between bulges 50 when the thread 40 is tightened during the stitching operation. The bulges 50 may be formed when the abutting peripheral portion of the cover members 20 are tightly secured together by the thread 40. The soft pad 30 allows the thread 40 to be engaged into the abutting peripheral portion of the cover members 20 and allows the bulges 50 to be formed.

The thread 40 may thus be suitably engaged between and protected by the bulges 50 and may thus be prevented from being easily broken.

Accordingly, the ball (baseball or softball) in accordance with the present invention includes a soft pad 30 engaged in the abutting peripheral portion of the two cover members 20 and for allowing the thread 40 to be engaged between bulges and for preventing the thread 40 from being easily broken.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ball comprising:

a core, at least two cover members engaged on said core and including an abutting peripheral portion, a pad engaged between said abutting peripheral portion of said at least two cover members and said core, said pad being made of resilient material, and at least one thread stitched along said abutting peripheral portion of said at least two cover members for forming a plurality of stitches and for securing said pad and said abutting peripheral portion of said at least two cover members together, said at least one thread being tightened and engaged into said resilient pad for forming a plurality of bulges between said stitches and for allowing said at least one thread to be engaged between and protected by said bulges.

* * * * *